US010370780B2

(12) United States Patent
Keulers et al.

(10) Patent No.: US 10,370,780 B2
(45) **Date of Patent: *Aug. 6, 2019**

(54) HIGH STRENGTH POLYAMIDE YARN

(71) Applicant: DSM IP ASSETS B.V., Heerlen (NL)

(72) Inventors: Martinus Joseph Maria Keulers, Echt (NL); Roman Stepanyan, Echt (NL); Hao Chen, Echt (NL)

(73) Assignee: DSM IP ASSETS B.V., Heerlen (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/551,633

(22) PCT Filed: Feb. 23, 2016

(86) PCT No.: PCT/EP2016/053734

§ 371 (c)(1),
(2) Date: Aug. 17, 2017

(87) PCT Pub. No.: WO2016/135122

PCT Pub. Date: Sep. 1, 2016

(65) Prior Publication Data

US 2018/0038019 A1 Feb. 8, 2018

(30) Foreign Application Priority Data

Feb. 23, 2015 (EP) ..... 15156175

(51) Int. Cl.
*D02G 3/04* (2006.01)
*D01D 5/16* (2006.01)
(Continued)

(52) U.S. Cl.
CPC ..... *D02G 3/04* (2013.01); *D01D 5/16* (2013.01); *D01F 6/80* (2013.01); *D02G 3/446* (2013.01);
(Continued)

(58) Field of Classification Search
None
See application file for complete search history.

(56) References Cited

U.S. PATENT DOCUMENTS 3,376,270 A * 4/1968 Ridgway ..... C08G 69/26 528/338
4,385,170 A * 5/1983 Hirami ..... C08G 69/32 528/183
(Continued)

FOREIGN PATENT DOCUMENTS

| | | |
|---|---|---|
| DE | 44 29 089 | 2/1996 |
| EP | 2 264 235 | 12/2010 |
| EP | 2 789 715 | 10/2014 |

OTHER PUBLICATIONS

International Search Report and Written Opinion of the ISA for PCT/EP2016/053734, dated Apr. 22, 2016, 11 pages.

*Primary Examiner* — Robert S Loewe
(74) *Attorney, Agent, or Firm* — Nixon & Vanderhye P.C.

(57) ABSTRACT

The invention relates to a yarn comprising a copolyamide in an amount of at least 90 wt % with respect to the total weight of the yarn, which copolyamide comprises a) at least 95 wt % by weight with respect to the total weight of copolyamide, monomeric units derived from hexamethylene diamine and adipic acid and b1) cyclic monomeric units derived from a diamine X, and cyclic monomeric units derived from a diacid Y, and/or b2) cyclic monomeric units derived from an amino acid Z, in which the summed amount of monomeric units derived from X,Y and Z is between 0.1 to 4.5 wt % by weight with respect to the total weight of the copolyamide and wherein the yarn has a tensile strength of at least 80 cN/tex as measured according to ASTM D885-04. The invention also relates to a process for preparing the yarn.

12 Claims, 1 Drawing Sheet

(51) Int. Cl.
*D01F 6/80* (2006.01)
*D02G 3/44* (2006.01)

(52) U.S. Cl.
CPC .... *D10B 2331/02* (2013.01); *D10B 2505/124* (2013.01)

(56) References Cited

U.S. PATENT DOCUMENTS 4,701,377 A 10/1987 Kurita et al.
5,360,667 A * 11/1994 Boles, Jr. ..... D01F 6/60 264/210.8
5,399,306 A * 3/1995 Follows ..... D01F 1/10 264/103
5,422,420 A * 6/1995 Shridharani ..... C08G 69/265 428/394
8,957,179 B2 * 2/2015 Kim ..... C08G 69/265 428/190
2003/0219595 A1 * 11/2003 Samant ..... D01D 5/092 428/373
2005/0142969 A1 * 6/2005 Yu ..... D01F 6/60 442/181
2009/0124149 A1 5/2009 Barnes et al.
2010/0304115 A1 12/2010 Kim
2011/0036447 A1 * 2/2011 Horiguchi ..... D01D 5/092 139/383 R
2011/0241249 A1 * 10/2011 Orange ..... B29C 70/465 264/257
2012/0225229 A1 * 9/2012 Ise ..... B60R 21/235 428/35.5
2013/0062806 A1 * 3/2013 Mitadera ..... C08J 5/24 264/129
2014/0302263 A1 * 10/2014 Ise ..... D03D 1/02 428/35.5

* cited by examiner

HIGH STRENGTH POLYAMIDE YARN

This application is the U.S. national phase of International Application No. PCT/EP2016/053734 filed 23 Feb. 2016, which designated the U.S. and claims priority to EP Patent Application No. 15156175.0 filed 23 Feb. 2015, the entire contents of each of which are hereby incorporated by reference.

FIELD

This invention relates to high strength polyamide yarns, as well as a process for preparing these yarns.

BACKGROUND AND SUMMARY

High strength polyamide yarns are known and are for example applied in tire cords, air bags. The yarns may be prepared from for example polyamide-6 or polyamide-66. There is a continuous demand for providing yarns with higher strengths, for which tenacity values is a measure to define strength. Fiber tenacity can be measured, e.g. by a STATIMAT 4U automatic tensile testing machine, according to ASTM D885-04. By having higher strength yarn, the total weight of the end product can be reduced in order to keep the same product strength, which is beneficial from an environmental perspective. For example, in the automotive industry, more and more air bags are being employed, which require high strength yarns. By increasing the strength of the yarn, the total weight of air bags can be reduced, which results in lower $CO_2$-emissions for the car. Alternatively, other applications become feasible for high strength yarns, in which strength is a key factor, such as ropes, tire cords, etc.

Many attempts have been made to increase strength of a yarn, which includes for example the preparation of yarns from thin filaments and utilizing special cooling equipment and steam treatment, as disclosed in EP2264235. EP2264235 discloses yarn for air bags comprising polyamide, in which the single fiber fineness is 1 to 2 dtex and in which strengths are reached of around 8.5 cN/dtex.

Another example in the prior art, disclosed in U.S. Pat. No. 4,701,377, allows preparing fibers stronger than 12 g/d (ca 10.5 cN/dtex) following a special spinning and drawing procedure, including superheated steam treatment.

The main disadvantage about the methods disclosed, however, is that special non-standard equipment is necessary to reach superior properties, which renders all these methods economically less attractive. Commercially available polyamide 6 and polyamide 66 yarns, produced with economically feasible processes, feature tenacity of no more than about 8.5 cN/dtex.

It is an object of the present invention to provide yarns which exhibit higher strengths and may be produced in an economically feasible way.

This object has been met by a yarn comprising a copolyamide in an amount of at least 90 wt % with respect to the total weight of the yarn, which copolyamide comprises a) at least 95 wt % by weight with respect to the total weight of copolyamide, monomeric units derived from hexamethylene diamine and adipic acid and b1) cyclic monomeric units derived from a diamine X, and cyclic monomeric units derived from a diacid Y, and/or b2) cyclic monomeric units derived from an amino acid Z, in which the summed amount of monomeric units derived from X,Y and Z is between 0.1 to 4.5 wt % with respect to the total weight of the copolyamide and wherein the yarn has a tensile strength of at least 80 cN/tex as measured according to ASTM D885-04.

DEFINITIONS

Figure 1:
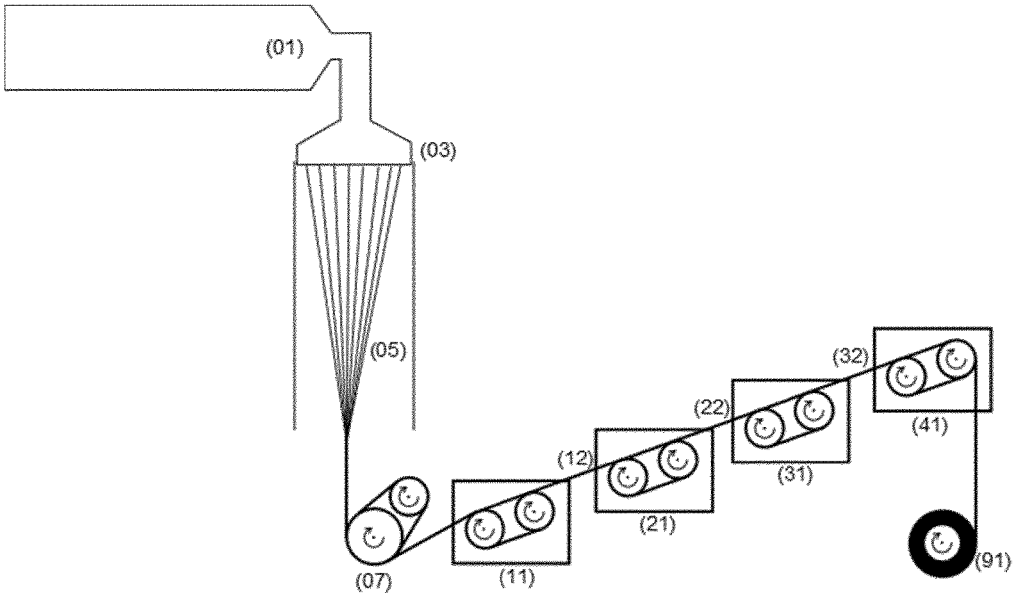
FIG. 1 is a schematic diagram of an apparatus that may be employed to perform an exemplary embodiment of a process according to the invention (process A)

Wt % is understood to be percentage by weight.

Essentially equal molar amounts is herein understood that the molar ratio of monomeric units derived from X:monomeric units derived from Y is between 0.8 and 1.2, preferably between 0.9 and 1.1 and even more preferred between 0.95 and 1.05. Preferably, the monomeric units derived from X and Y are present in essentially equal molar amounts.

With homopolyamide herein is understood a polyamide which consists essentially of monomeric units derived from hexamethylene diamine and adipic acid. This polyamide is also referred to as PA-66.

A copolyamide herein is understood to be a copolyamide which comprises besides a majority of monomeric units derived from hexamethylene diamine and adipic acid, further monomeric units derived from a diamine and a diacid and/or an aminoacid. These further monomeric units are thus different from hexamethylene diamine or adipic acid. Such copolyamide may be denoted as PA-66/XY, in which X refers to a further diamine and Y refers to a further diacid or PA-66/Z, in which Z refers to an aminoacid or PA-66/XY/Z. A copolyamide is to be distinguished from a blend, which is for example denoted as PA-66/PA-XY or PA-66/PA-Z. A blend is prepared by mixing two polyamides, whereas a copolyamide is prepared by mixing monomers which subsequently polymerize to a copolyamide.

With monomers is herein understood a molecule that when chemically bound to other monomers forms a polymer. For polyamides, potential monomers include for example aminoacids, diamines and diacids, as well as their salts.

With monomeric unit is herein understood a unit derived from a monomer as it is present in a polymer.

Hydrogenated is herein understood that all aromatic rings are fully hydrogenated into a cyclic aliphatic unit.

DETAILED DESCRIPTION OF EXEMPLARY EMBODIMENTS

The inventors have surprisingly found that a yarn according to the invention exhibits higher strengths as compared to a yarn which are made from a homopolyamide. Another advantage is that the yarns can be prepared by a simple process.

Suitable cyclic monomeric units derived from diamines X include for example:

C6 to C20 aromatic diamine, such as m- or p-phenylenediamine,

C7 to C20 arylaliphatic diamine, such as 4,4'-diaminodiphenylpropane, meta-xylylene diamine (MXD), para-xylylene diamine (PXD), C6 to C20 cyclic aliphatic diamine, such as 1,4-diaminocyclohexane, 4-aminomethylcyclohexylamine, 5-Amino-1,3,3-trimethylcyclohexanemethylamine (also referred to as isophorone diamine, IPD), 3,3'-dimethyl-4,4'-diamino-dicyclohexylmethane, bis-(p-aminocyclohexane)methane, 2,2-di(4-aminocyclohexyl)-propane, 3,6-bis(aminomethyl)norbornane, including stereo isomers and/or cis trans isomers thereof.

Preferably, the cyclic monomeric units derived from diamines X are monomeric units derived from C6 to C20 cyclic aliphatic diamines as listed above, as these exhibit a higher reactivity and are easier built in a copolyamide. Suitable cyclic monomeric units derived from dicarboxylic acids Y include for example:

C8 to C20 aromatic dicarboxylic acid, such as naphthalene-2,6-dicarboxylic acid, naphthalene-1,4-dicarboxylic acid, isophthalic acid (I), terephthalic acid (T), C8 to C20 arylaliphatic dicarboxylic acid, such as o-, m- or p-phenylenediacetic acid, 4-methylisophthalic acid, 4-tert-butylisophthalic acid C6 to C20 cyclic aliphatic dicarboxylic acid, including hydrogenated naphthalene dicarboxylic acids, hydrogenated 2,6-naphthalene dicarboxylic acid, as well as 1,4-cyclohexane dicarboxylic acid, 1,3-cyclohexane dicarboxylic acid, including stereo isomers and/or cis trans isomers thereof. Preferably, the cyclic monomeric units derived from dicarboxylic acids are derived from isophthalic acid as this is easily dissolved in water and can be easier dosed. Another preferred cyclic monomeric unit is derived from terephthalic acid as this is readily available.

Suitable cyclic monomeric units derived from amino acids Z include monomeric units derived from 4-aminomethylcyclohexylcarboxylic acid, 4-aminocyclohexaneacetic acid, including cis and trans isomers thereof.

Preferably, the cyclic monomeric units derived from X and Y and/or Z, have at least one cyclic structure containing 5 or 6 carbon atoms, such as a cyclo pentane structure, phenyl structure or cyclo hexane structure, which may for example be derived from 1,3 diaminocyclopentane, isophorone diamine, terephthalic acid, isophthalic acid.

Preferably, the yarn comprises a copolyamide in an amount of at least 95 wt % with respect to the total weight of the yarn, which copolyamide comprises a) at least 95 wt % by weight with respect to the total weight of copolyamide, monomeric units derived from hexamethylene diamine and adipic acid and b1) cyclic monomeric units derived from a diamine X, and cyclic monomeric units derived from a diacid Y, in which the summed amount of monomeric units derived from X and Y is between 0.5 to 4.0 wt % with respect to the total weight of the copolyamide. Preferably, monomeric units derived from X and Y are present in essentially equal molar amounts.

Most preferred is a yarn, comprising a copolyamide in an amount of at least 95 wt % with respect to the total weight of the yarn, which copolyamide comprises a) at least 95 wt % by weight with respect to the total weight of copolyamide, monomeric units derived from hexamethylene diamine and adipic acid and b1) cyclic monomeric units derived from a diamine X being isophorone diamine, and cyclic monomeric units derived from a diacid Y chosen from isophthalic acid and terephthalic acid, in which the summed amount of monomeric units derived from X and Y is between 0.5 to 4.0 wt % with respect to the total weight of the copolyamide.

The yarn comprises a copolyamide in an amount of at least 90 wt % with respect to the total weight of the yarn, preferably at least 95 wt % and most preferred at least 97 wt %. The yarn may comprise other additives which may be for example stabilizers as well as pigments.

In many applications, including for example air bag fabrics, high tenacity, low titer, low hot air shrinkage (HAS) yarns are desired. The yarn according to the invention preferably has a titer of between 200 dtex and 700 dtex, more preferably between 300 dtex and 500 dtex and most preferred between 300 dtex and 400 dtex. A lower titer of the yarns allows weight savings, but also allows for example more compact, better foldable fabrics prepared from the yarn, such as for example in applications of air bags.

To ensure the product strength in combination with a thin fabric, low titer yarns are preferably used in combination with a high tenacity. The usage of 450 dtex to 500 dtex yarns typically requires a yarn with a tenacity of at least 80 cN/tex.

The yarn according to the invention exhibits a tensile strength of at least 80 cN/tex as measured according to ASTM D885-04, preferably the yarn has a tensile strength of at least 85 cN/tex and more preferably at least 90 cN/tex. Yarns with a tensile strength of at least 80 cN/tex are also herein referred to as technical yarns, in contrast to textile yarns. Textile yarns usually have lower tensile strength and are usually not suitable for applications in which technical yarns are employed.

Even more preferred, the yarn has a titer of between 300 dtex and 400 dtex and a tenacity of at least 85 cN/tex, most preferred the yarn has a titer of between 300 dtex and 400 dtex and a tenacity of at least 90 cN/tex, as this allows thinner fabrics with higher strength.

In another embodiment, the yarn according to the invention has a hot air shrinkage of at most 8.0%, preferably at most 5.0%, as this allows for higher dimensional stability. HAS is measured at 177° C. after 2 min, as explained below. Minimum HAS values may be as low as 1.0%.

In yet another embodiment, the yarn according to the invention has a HAS of at most 8.0%, preferably at most 5.0% and a tenacity of at least 80 cN/tex, preferably at least 85 cN/tex, and a titer of between 200 dtex and 700 dtex, preferably between 300 dtex and 500 dtex.

Test Methods:

Conditioning: prior to all the measurements, described below, bobbins containing the yarns, were conditioned for at least 12 hours in a 55% relative humidity 23° C. atmosphere.

Tensile strength of fibers, also known as tenacity, is measured according to ASTM D885-04 and given in cN/dtex or cN/tex. The measurement was performed using STATIMAT 4U automatic tensile testing machine.

Fiber titer, also referred to as linear density, measured in dtex, is defined as weight in grams of 10000 meters of yarn. The titer can be measured by weighing a piece of yarn of a known length, usually 20 meters, on a balance with accuracy of 0.001 g and then recalculating the weight of 10000 meters of yarn. In practice, the titer measurement is automated and performed by STATIMAT 4U as well.

Hot air shrinkage (HAS) is measured according to ASTM D4974-04 at 177° C. for 2 minutes using Testrite shrinkage measurement instrument under a load of 5 mN/tex.

Process for Preparing Yarns:

A process for preparing a yarn according to the present invention generally comprises the following steps and is further referred to as process A:

Providing a composition comprising a copolyamide to an extruder and melting it, optionally mixing with additives, such as stabilizer or pigment, to obtain a molten composition;

The molten composition is extruded through a spinneret to form filaments, which are subsequently stretched, cooled and combined to form at least one yarn;

The at least one yarn is subsequently subjected to a drawing process at a temperature of between 25° C. and 265° C. to a draw ratio of between 4 and 6. Preferably the drawing is carried out at a temperature between 50° C. and 215° C. The drawing may be performed, e.g., by means of pairs of heated draw rolls, heated hot air ovens, etc;

Optionally, after drawing the yarn is subjected to a relaxation and/or a heat set step;

The at least one yarn is wound up. Preferably, the at least one yarn is wound up on a bobbin.

An example of the apparatus to perform the process A is illustrated in FIG. 1.

The composition is molten and, if necessary, mixed with additives such as for example stabilizers, pigments, in an extruder (01) and further extruded through a spinneret (03) to form filaments. The filaments (05) are cooled, drawn and combined to at least one yarn between the spinneret (03) and take up rolls (07). Further a two stage drawing of the yarn is performed. First, the yarn is heated up by a pair of rolls (11) to a temperature between 50° C. and 80° C. and drawn 2 to 3 times in air gap (12) between pairs of rolls (11) and (21). Then, the yarn is heated up by a pair of rolls (21) to a temperature between 120° C. and 245° C. and drawn 1.35 to 3 times in air gap (22), between pairs of rolls (21) and (31), resulting in a draw ratio between 4 and 6. The drawing steps are followed by heat setting and relaxation: the yarn is heated up to the temperatures of 200° C. to 245° C. by a pair of rolls (31) and relaxed by 0% to 10% in the air gap (32) between the pairs of rolls (31) and (41). Finally, the yarn is wound up on a bobbin by a reel device (91).

The yarn according to the invention is preferably made by a process, hereafter referred to as process B, which comprises the following steps:

Providing a composition comprising a copolyamide to an extruder and melting it, optionally mixing with additives, such as stabilizer or pigment, to obtain a molten composition;

The molten composition is extruded through a spinneret to form filaments, which are subsequently stretched, cooled and combined to form at least one yarn;

The at least one yarn is subsequently subjected to a drawing process at a temperature between 25° C. and 265° C. to a draw ratio of between 4 and 6. Preferably the drawing is carried out at a temperature between 50° C. and 215° C. The drawing may be performed, e.g., by means of pairs of heated draw rolls, heated hot air ovens, etc.

After drawing, the yarn is relaxed by from 4% to 10% in at least three stages while being kept in a temperature range of 250° C. to 260° C.

The at least one yarn is wound up. Preferably, the at least one yarn is wound up on a bobbin.

Preferably, the temperature during relaxation is higher than the highest temperature during drawing. This has the advantage that the relaxation is more effective. More preferably, the temperature during relaxation is increased in each subsequent stage. This has the advantage that sufficient yarn tension is maintained between the relaxation rolls, which avoids breaking of the yarn.

The advantage of process B is that it yields yarns with a lower hot air shrinkage as compared to process A.

Figure 2:
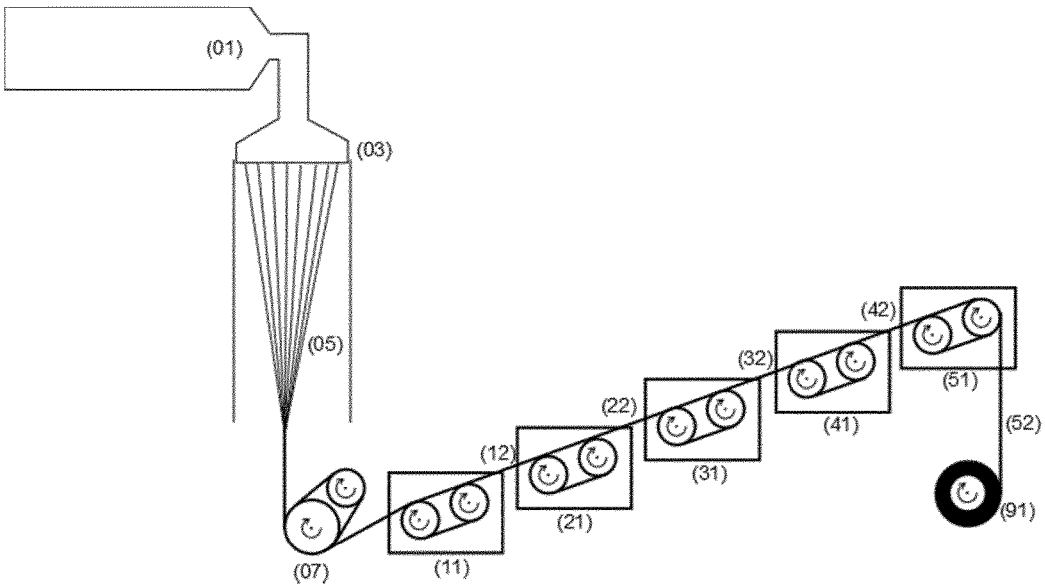
FIG. 2 is a schematic diagram of an apparatus that may be employed to perform another exemplary embodiment of a process according to the invention (process B).

An example of the apparatus to perform process B is illustrated in FIG. 2. The difference between FIG. 2 and the process described in FIG. 1 is that five heated roll pairs (11), (21), (31), (41), (51) are employed, instead of four. The extrusion (01), the spinneret (03), the air gap (05), the take up rolls (07) as well as the first two roll pairs (11), (21) conditions can be chosen in the same way as in the process A, as illustrated in FIG. 1. To achieve low HAS values, rolls (31), (41) and (51) have to be set to a temperature of between 250° C. and 260° C., the yarn being relaxed by from 4% to 10% in the at least three stages (32), (42), (52). The yarn is subsequently wound up on a reel device (91).

Applications for the yarn according to the invention include air bag fabric such as air bags for driver, passenger, knee, curtain airbags. Other applications include ropes, tire cords.

Example 1 (Ex 1)

A 350 dtex yarn consisting of 72 filaments is prepared from a copolyamide PA66/IPDT according to process A. The copolyamide is synthesized from a mixture of hexamethylene diamine, adipic acid, isophorondiamine (IPD), and terephthalic acid (T). The monomeric unit derived from IPD was 0.5 wt % with respect to the copolyamide and the monomeric unit derived from T was 0.5 wt % with respect to the copolyamide. The remainder of the copolyamide are monomeric units derived from hexamethylene diamine and adipic acid, thus 99 wt %.

The process is applied using an apparatus as illustrated in FIG. 1. After take up, the yarn is drawn in a two-step process to a draw ratio of 5.0. After hot drawing, relaxation of in total 6% is applied between the $3^{rd}$ and the $4^{th}$ rolls pair and between the $4^{th}$ rolls pair and the reeling device.

The yarn has an expected tenacity of about 93 cN/tex, elongation at break of 20%, and an expected hot air shrinkage, at 177° C. 2 min, of about 7%.

Example 2 (Ex 2)

The same copolyamide is used as in the Example 1. The yarn is prepared according to process B using an apparatus as illustrated in FIG. 2. After take up, the yarn was drawn in a two-step process to a draw ratio of 4.9. After hot drawing, three-step relaxation process of in total 10% has been applied between the $3^{rd}$ and the $4^{th}$ rolls pair, between the $4^{rd}$ and the $5^{th}$ rolls pair and between the $5^{th}$ rolls pair and the reeling device.

The yarn has an expected tenacity of 90 cN/tex, elongation at break of 22%, titer of 350 dtex, and an expected hot air shrinkage, at 177° C. 2 min, of 4%.

Comparative Example A (Comp A)

A 350 dtex yarn consisting of 72 filaments is prepared from a homopolyamide PA66 according to process A. The homopolymer is synthesized from hexamethylene diamine and adipic acid contributing 100 wt % of the monomers.

The process is performed using an apparatus as illustrated in FIG. 1. After take up, the yarn is drawn in a two-step draw process to a draw ratio of 4.5. Higher draw ratios are not achievable as they lead to spinline breakages.

After hot drawing, relaxation of in total 6% is applied between the $3^{rd}$ and the $4^{th}$ rolls pair and between the $4^{th}$ rolls pair and the reeling device.

The yarn has an expected tenacity of 85 cN/tex, elongation at break of 18%, and an expected hot air shrinkage, at 177° C. 2 min, of 6%.

Comparative Example B (Comp B)

The same homopolyamide PA66 is used as in the Comparative Example A and the yarn is prepared according to process B using an apparatus as illustrated in FIG. 2. After take up, the yarn is drawn in a two-step process to a draw ratio of 4.3.

After hot drawing, three-step relaxation process of in total 10% is applied between the $3^{rd}$ and the $4^{th}$ rolls pair, between the $4^{rd}$ and the $5^{th}$ rolls pair and between the $5^{th}$ rolls pair and the reeling device.

The yarn has an expected tenacity of 81 cN/tex, elongation at break of 25%, titer of 350 dtex, and expected hot air shrinkage, at 177° C. 2 min, of 4%.

The examples show the advantages of the yarn according to the invention as compared to a yarn prepared from a homopolyamide.

As Example 1 shows, the yarn according to the invention can be drawn to a draw ratio of 5.0 and reaches a tenacity of about 93 cN/tex.

As Comparative example A shows, a homopolyamide being spun at very similar conditions can be drawn only 4.5 times resulting in a yarn with tenacity of about 85 cN/tex, which is approximately 10% lower than the yarn made with the copolyamide from the Example 1.

Example 2 illustrates that if a process B is employed yarns with a tenacity of about 90 cN/tex and low hot air shrinkage can be obtained by employing the copolyamide.

If a homopolyamide is used in a process B as shown in the Comparative example B, then the yarn tenacity reaches only about 81 cN/tex, which is approximately 10% lower than the yarn obtainable from the copolyamide in Example 2.

The invention claimed is:

1. A process for preparing a yarn which comprises the following steps:

(a) providing a composition comprising a copolyamide comprised of at least 95 wt % with respect to the total weight of the copolyamide of (i) monomeric units derived from hexamethylene diamine and adipic acid, and (iia) cyclic monomeric units derived from a diamine X, and cyclic monomeric units derived from a diacid Y and/or (iib) cyclic monomeric units derived from an amino acid Z, wherein the monomeric units derived from the diamine X, the diacid Y and the amino acid Z are present in a summed amount of between 0.1 to 4.5 wt % with respect to the total weight of the copolyamide;

(b) directing the composition to an extruder, optionally mixing the composition with additives, and melting the composition optionally mixed with additives in the extruder to obtain a molten composition;

(c) extruding the molten composition through a spinneret to form filaments and thereafter stretching, cooling and combining the filaments to form at least one yarn;

(d) subjecting the at least one yarn to a drawing process at a temperature between 25° C. and 265° C. to achieve a draw ratio between 4 and 6 to thereby obtain at least one drawn yarn;

(e) relaxing the at least one drawn yarn by 4% to 10% in at least three relaxing stages while maintaining the at least one drawn yarn in a temperature range of 250° C. to 260° C.; and thereafter (f) winding up the at least one drawn yarn, wherein the at least one drawn yarn has a tensile strength of at least 80 cN/tex as measured according to ASTM D885-04.

2. The process according to claim 1, wherein the drawing process according to step (d) is carried out at a temperature between 50° C. and 215° C.

3. The process according to claim 1, wherein the additives comprise a stabilizer and/or a pigment.

4. The process according to claim 1, wherein the monomeric units derived from the diamine X and the diacid Y are present in substantially equal molar amounts.

5. The process according to claim 1, wherein the at least one drawn yarn has a tensile strength of at least 85 cN/tex as measured according to ASTM D885-04.

6. The process according to claim 1, wherein the summed amount of the monomeric units derived from the diamine X, the diacid Y and the amino acid Z is between 0.5 to 4.0 wt % with respect to the total weight of the copolyamide.

7. The process according to claim 1, wherein the diamine X is isophorone diamine and the diacid Y is isophthalic acid and/or terephthalic acid.

8. The process according to claim 1, wherein the at least one drawn yarn has a hot air shrinkage (HAS) of between 1.0 to 7.0% as measured according to ASTM D4974-04 at 177° C. for 2 minutes.

9. The process according to claim 1, wherein the at least one drawn yarn has a titer of between 200 to 700 dtex.

10. The process according to claim 9, wherein the at least one drawn yarn has a titer of between 300 dtex and 500 dtex and a tenacity of at least 85 cN/tex.

11. The process according to claim 1, wherein the yarn has a hot air shrinkage (HAS) of at most 5.0%, a tenacity of at least 85 cN/tex, and a titer of between 300 dtex and 500 dtex.

12. An air bag fabric comprising a yarn made by the process according to claim 11.

* * * * *